United States Patent [19]

Uhtenwoldt

[11] 4,167,837

[45] Sep. 18, 1979

[54] METHOD FOR CONTROLLING A GRINDING WHEEL-WORKPIECE INTERFACE FORCE FOR A WORKPIECE WITH DIVERSE GRINDABILITY CHARACTERISTICS

[75] Inventor: Herbert R. Uhtenwoldt, West Boylston, Mass.

[73] Assignee: Cincinnati Milacron-Heald Corp., Worcester, Mass.

[21] Appl. No.: 875,152

[22] Filed: Feb. 6, 1978

[51] Int. Cl.[2] ..... B24B 1/00

[52] U.S. Cl. ..... 51/281 R; 51/101 R; 51/165.89; 51/165.92

[58] Field of Search ..... 51/101 R, 281 R, 165 TP, 51/165.71, 165.72, 165.89, 106 R, 165.92

[56] References Cited

U.S. PATENT DOCUMENTS

| | | | |
|---|---|---|---|
| 3,344,559 | 10/1967 | Inaba | 51/165 TP |
| 3,864,879 | 2/1975 | Maismith | 51/101 R |
| 3,878,652 | 4/1975 | Mosher | 51/165.89 |
| 3,914,907 | 10/1975 | Hofelt | 51/281 R |
| 4,005,552 | 2/1977 | Hoglund | 51/101 R |
| 4,014,142 | 3/1977 | Coes | 51/165.92 |

*Primary Examiner*—Harold D. Whitehead
*Attorney, Agent, or Firm*—James D. Liles; Jack J. Earl

[57] ABSTRACT

A method and apparatus are disclosed for grinding a surface upon a workpiece having disparate grindability characteristics. A mechanical cam is used in the preferred embodiment to model the characteristics of a cylindrical surface and is rotated with the workpiece. The cam imparts motion to a follower which in turn imparts the motion to a pulse generator. Electrical signals which are dependent upon the angular orientation of the workpiece and the grindability characteristics of a circumferential sector of the workpiece in grinding contact with an abrasive wheel are produced by the pulse generator and used to partially control the infeed movement and the interface force between the workpiece and the abrasive wheel.

7 Claims, 7 Drawing Figures

DIVIDE BY "2" CIRCUIT
PULSE GENERATOR LOGIC CIRCUIT
DIRECTION PHASING CIRCUIT
CHANNEL A
CHANNEL B
POWER SUPPLY
STEPPING MOTOR
SEQUENCE DRIVER
INTERFACE CIRCUIT
CORRECTION MODE CIRCUIT
DIGITAL FEED CONTROL

METHOD FOR CONTROLLING A GRINDING WHEEL-WORKPIECE INTERFACE FORCE FOR A WORKPIECE WITH DIVERSE GRINDABILITY CHARACTERISTICS

BACKGROUND

In grinding surfaces upon workpieces, the always difficult problem of maintaining a proscribed geometry to a low tolerance is compounded substantially whenever the grindability characteristics are variable upon a single surface. Due to the variable grinding characteristics, different metal removal rates may result for different sections upon the single surface whenever the grinding wheel-workpiece interface force is constant. For example, for a constant engagement force between the grinding wheel and a workpiece, the metal removal rate for an extremely hard material will frequently be less than the corresponding removal rate for a softer material. If the extremely hard material is intermittently inserted into a section of the surface of a parent workpiece of a softer material, as is done in a variety of applications, the resulting surface to be ground has disparate grindability characteristics. The disparity in the grinding characteristics of the two materials obviously presents problems in grinding surfaces which require a high degree of geometric exactitude.

Different grindability characteristics are also presented by a surface which is partially interrupted, as for example, interruptions, by holes and/or flats. Holes and/or flats vary the contact area between the grinding wheel and the workpiece and frequently vary the unit force applied to the contacted portions of the surface. Since the metal removal rate is most commonly a function of the applied unit force, it varys accordingly. Consequently, holes and/or flats frequently have presented problems in forming proscribed geometrics during the grinding process in prior art machines.

Further, virtually all grinding machines experience some deflection in the grinding wheel support system whenever the wheel is urged against the workpiece. This deflection results in a reactant spring force which is applied against the workpiece, the magnitude of the spring force being proportional to the product of the support system spring rate and the magnitude of the deflection. Deflection is particularly pronounced when the grinding wheel is mounted upon a quill in cantilevered support, as the wheel support system not only experiences deflection in the bearings and the wheel itself, but the quill supporting the grinding wheel inherently defects substantially whenever a force, such as that resulting from engagement with a workpiece, is applied to its end portion. The unequal resistances offered by disparate grinding characteristics upon different sections of a single grinding surface result in different deflections and consequently different metal removal rates for the different sections of the surface; and this nonuniformity of metal removal rates produces a part which does not meet the proscribed geometrical tolerances.

SUMMARY OF THE INVENTION

The invention relates to grinding methods for grinding surfaces with variable grindability characteristics.

A workpiece having varying grindability characteristics is supported upon a grinding machine having an abrasive wheel and means for effectuating relative infeed motion between the abrasive wheel and the workpiece. Signals representative of the grindability are generated and used to control the relative infeed rate or the abrasive wheel-workpiece interface force.

In the preferred embodiment, a cylindrical workpiece is rotated about an axis of rotation and the infeed signals are varied as a function of the angular orientation. The infeed signals are initiated by a mechanical cam which is modeled to correspond to the grinding characteristics of discrete circumferential sectors of the workpiece. The cam is rotated with the workpiece and used to activate a pulse generator which produces an electrical signal which is communicated to an electrical stepping motor drive to modify the infeed motion to match the grinding characteristics of discrete radial sectors with a commensurate abrasive wheel-workpiece interface force.

The method of grinding disparate surfaces of revolution includes first determining the grindability characteristics for discrete sectors of the surface to be ground. This information is then recorded and the workpiece is moved relative to the abrasive wheel. The recorded information, representative of the determined characteristics upon the workpiece surface, is reproduced and matched to the abrasive wheel contact with the discrete sector. The reproduced recorded information is then used to vary the interface force between the workpiece and an abrasive wheel.

BRIEF DESCRIPTION OF THE DRAWINGS

FIG. 7 is a schematic representation of a correction circuit for partially controlling the infeed of the grinding machine of FIG. 1.

DETAILED DESCRIPTION OF THE PREFERRED EMBODIMENT

The invention relates to grinding machines and will be disclosed in connection with an internal grinder having a cantilever supported abrasive wheel used to grind a workpiece having disparate grindability characteristics upon a single surface of revolution.

Figure 1:
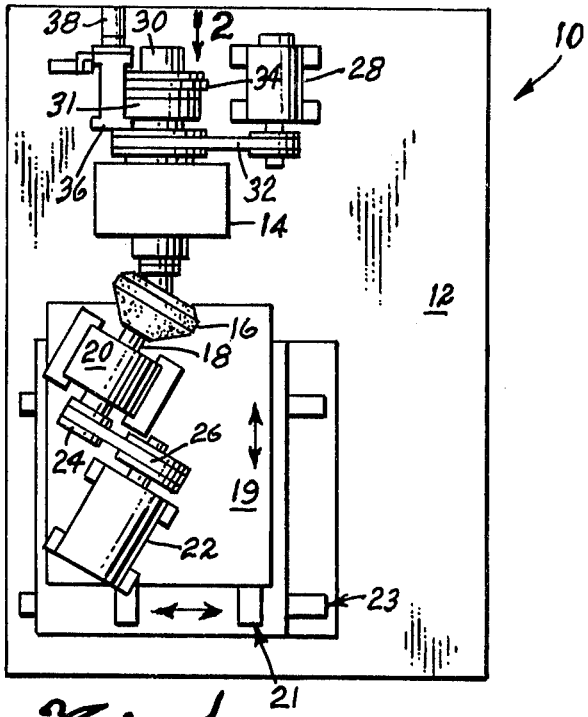
FIG. 1 is a plan view of one type of grinding machine which might employ the method and apparatus of the present invention.

Referring now to the drawings and to the environmental view of FIG. 1 in particular, one type of grinding machine 10 which might employ the present invention is depicted. The grinding machine 10 has a base 12 upon which a workpiece fixture 14 and an abrasive or grinding wheel 16 are supported. The abrasive wheel 16 is mounted upon a quill 18 in cantilevered support. The quill 18 is rotatably supported by a spindle (not shown)

mounted upon bearings within a housing 20 which is in turn supported upon the base 12. A motor 22 is drivingly engaged to a spindle drive 24 by belts 26 to rotate the spindle and consequently the grinding wheel in a conventional fashion. The housing 20 as well as the motor 22 and the spindle drive 24 are all mounted upon a wheelhead platform 19 which is movable in mutually perpendicular directions upon way systems 21 and 23, respectfully.

The workpiece fixture 14 which supports and rotates the workpiece is driven by a second motor 28 which is drivingly engaged to the workpiece spindle 30 by a belt 32. Also mounted upon the workpiece spindle 30 upon the end opposite from the fixture 14, is a cam holder 31 (best seen in FIG. 3) which in turn supports a cam 34. Since both the cam 34 and the fixture 14 are both mounted upon the spindle 30, each experiences the same angular displacement whenever the spindle 30 is rotated by the motor 28.

Figure 3:
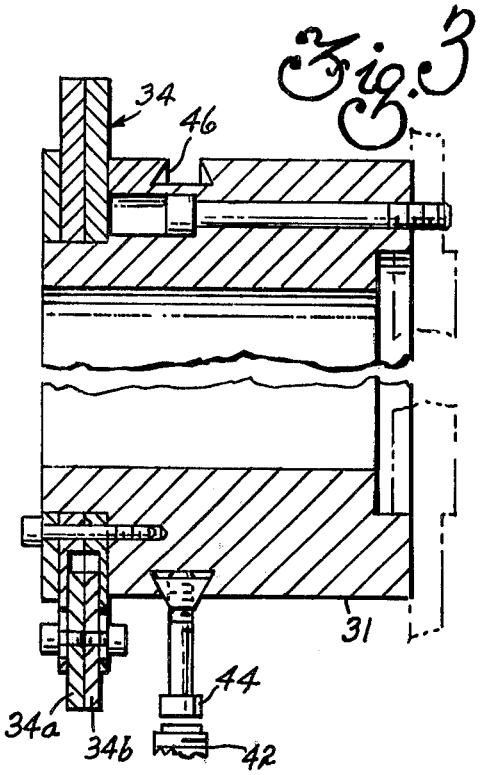
FIG. 3 is a side cross-sectional elevational view of the apparatus of FIG. 2 taken along the line 3—3 in FIG. 2.
Figure 2:
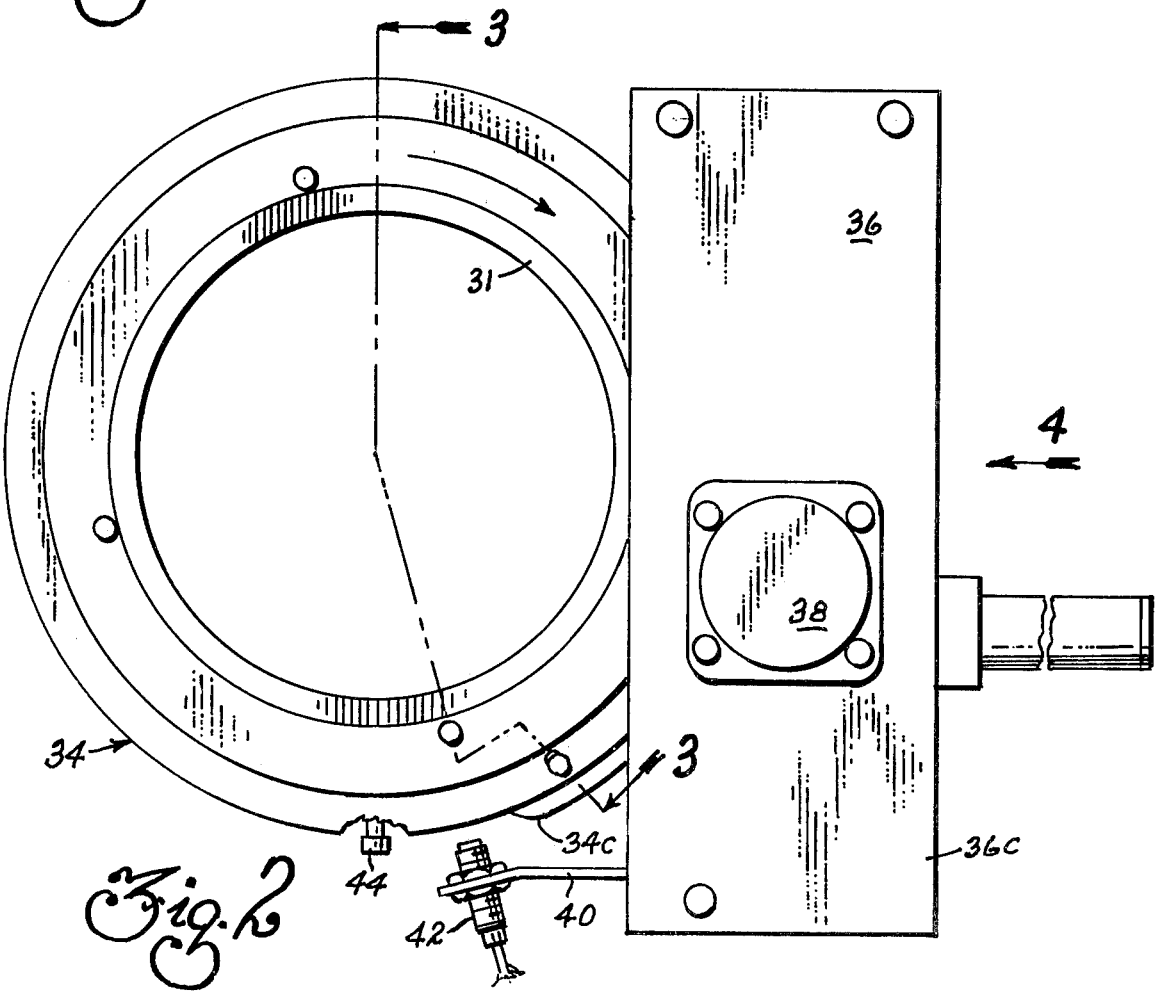
FIG. 2 is an end view of a portion of the apparatus of the preferred embodiment taken in the direction of arrow 2 in FIG. 2, with details removed for clarity of illustration.

As shown more clearly in the views of FIG. 2 and FIG. 3, the cam 34 has two inserts **34*a* and 34*b* which are adjustable relative to each other and to the rotational axis in order to vary both the radial and circumferential dimensions of a lobe 34*c* upon the cam 34. A bracket 36 is juxtaposed to the cam 34 and supports a pulse generator 38. Also supported by the bracket 36 is an auxiliary cantilever bracket 40 upon which a proximity switch 42 is mounted. As most readily appreciated from a joint viewing of FIGS. 2 and 3, a screwhead 44 extends radially outward from an annular groove 46 within cam holder 31 and passes in close proximity to the proximity switch 42 as the spindle 30, and consequently the cam 34 has rotated about its axis. As explained later in detail, the proximity switch 42 is used to generate signals representative of the angular orientation of the cam 34 to commence and terminate operation of the pulse generator 38**.

Figure 4:
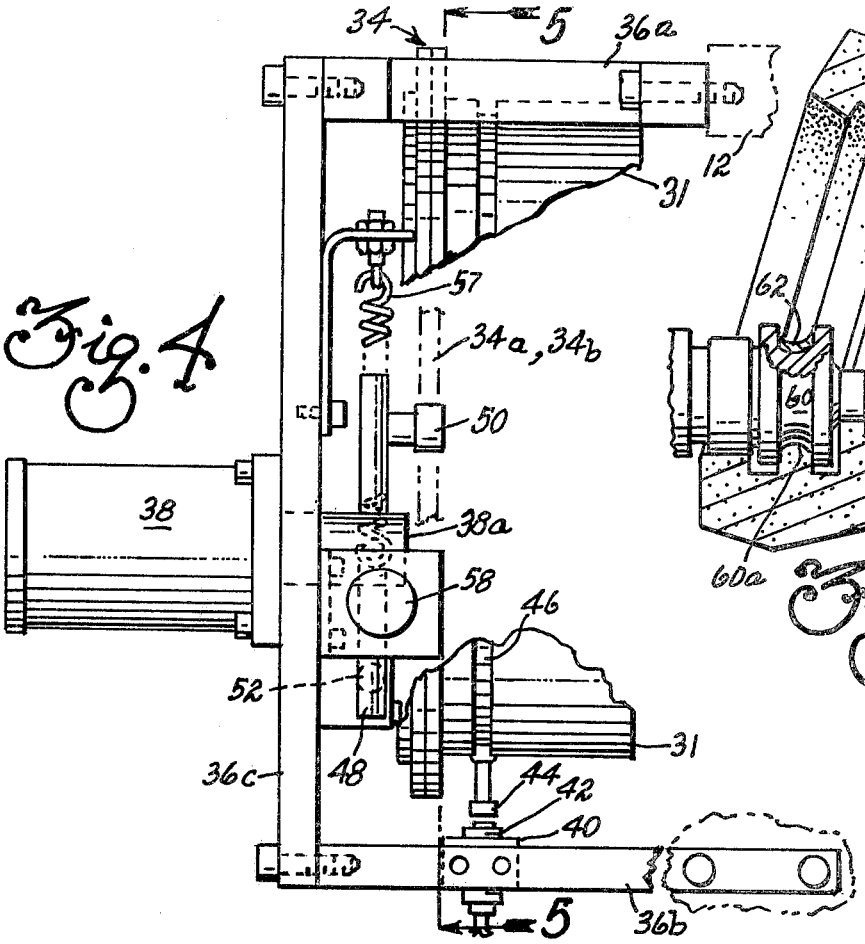
FIG. 4 is a side elevational view of the apparatus of FIGS. 2 and 3 taken in the direction of arrow 4 in FIG. 2.
Figure 5:
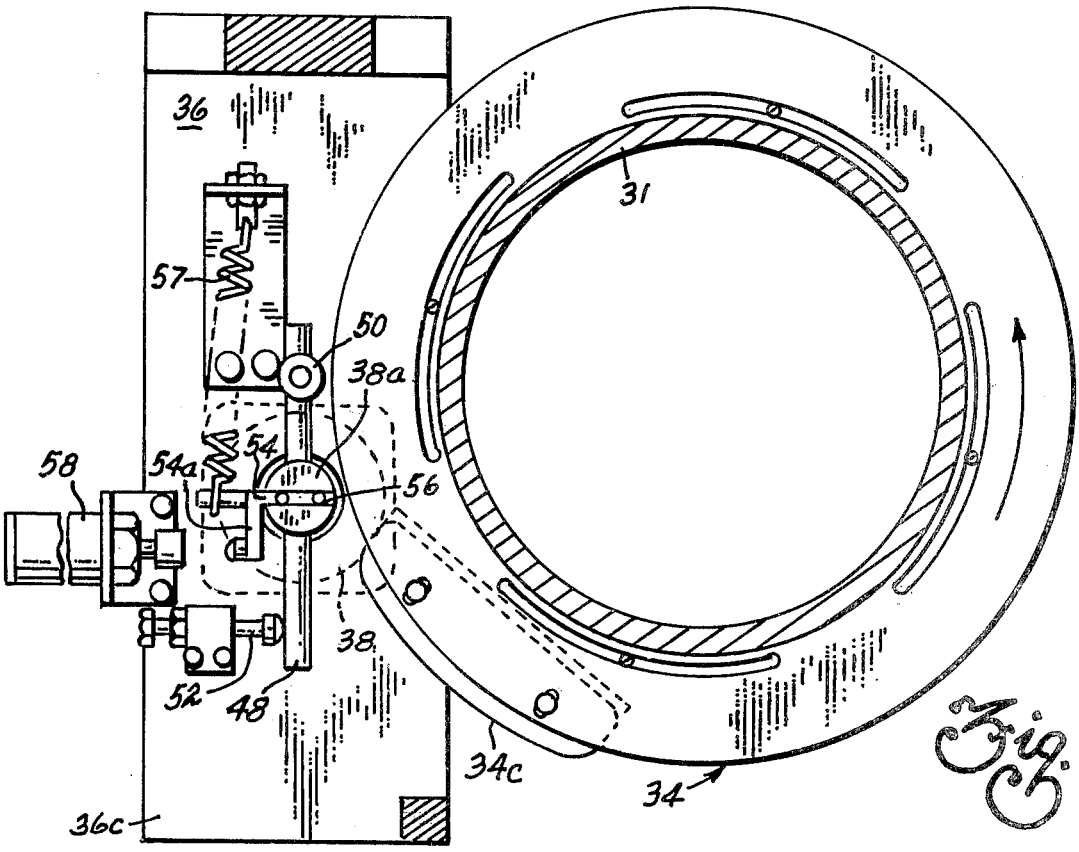
FIG. 5 is a cross-sectional end view of the apparatus of FIGS. 2 through 4 taken along the line 5—5 in FIG. 4.
Figure 1:
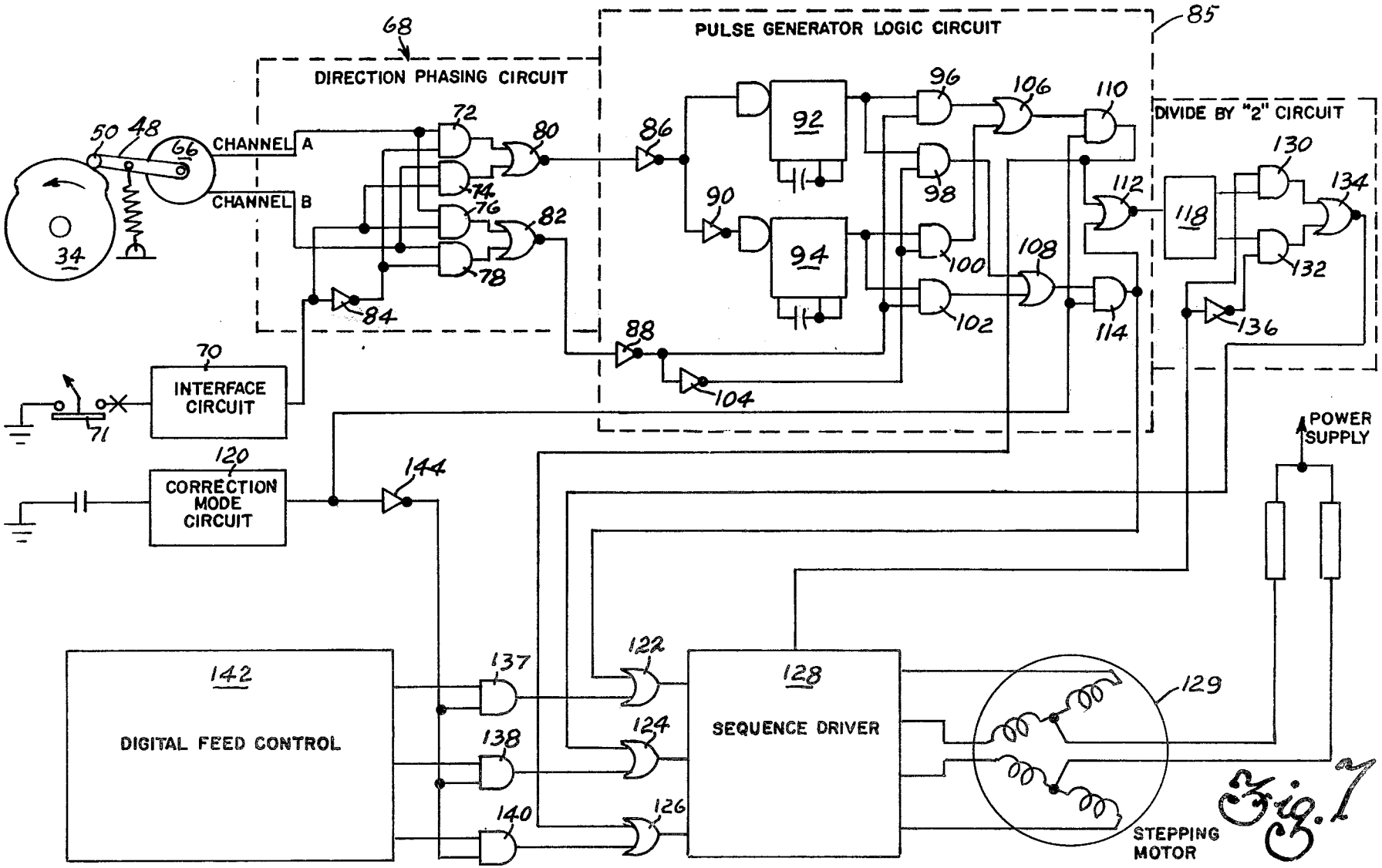

The details of the mechanism activated by the cam 34 are most clearly illustrated in FIGS. 4 and 5. The bracket 36 is actually constructed of three separate sections **36*a*, 36*b*, 36*c*, the section 36*c* extending between sections 36*a* and 36*b*. Each of the sections 36*a*, 36*b*, and 36*c* are connected together in a conventional fashion; and sections 36*a* and 36*b* are in turn fastened to the base 12 in a suitable manner to achieve juxtapositional relationship to the cam 34. The pulse generator 38 is mounted in section 36*c* and has a shaft 38*a* which extends through the section 36*c* of the bracket 36. A follower arm 48 extends through the shaft 38*a* interiorally of the section 36*c* of the bracket 36 in a direction perpendicular to the rotary axis of the shaft 38*a*. A cam follower 50 is mounted near one terminus of the follower arm 48 at a predetermined distance from the axis of rotation of shaft 38 such that it will be responsive to cam 34 and may be selectively moved according to the dictates of the cam contours. Movement of the cam follower 50 rotates the shaft 38*a* of the pulse generator 38. The pulse generator 38 then produces a predetermined number of electrical pulses for each incremental angular displacement of the shaft 38*a***.

The follower arm 48 extends through the shaft **38*a* and selectively contacts an adjustable stop 52 near its end portion opposite the cam follower 50. Stop 52 limits the clockwise motion of the cam follower arm 48** as viewed in FIG. 5.

A lever 54 is fitted into a groove 56 in the end face of the shaft **38*a*. The groove 56 extends in a direction perpendicular to both the axis of shaft 38*a* and follower arm 48. An extension spring 57 is attached to the lever 54 at a location radially spaced from the axis of rotation of the shaft 38*a*. The spring 57 biases the arm 48 against the stop 52**.

An L-shaped portion **54*a* of the lever 54 extends perpendicular to the groove 56 in a direction parallel to the follower arm 48. A hydraulic cylinder 58 with an axis of motion perpendicular to the direction of shaft 38*a* engages the L-shaped portion 54*a* when activated to overcome the bias of spring 57 and to rotate the cam follower 50 (counterclockwise as view in FIG. 5) to an inactive position out of the path of the cam 34**.

Figure 6:
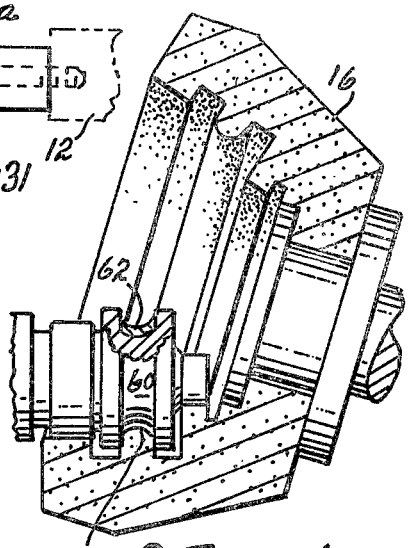
FIG. 6 is a side elevational view, partially in cross-section, of a workpiece which might be machined upon the apparatus of the present invention in contact with an abrasive wheel.

FIG. 6 illustrates a workpiece 60 upon which the method and apparatus of the present invention might be effectively employed. The workpiece 60 is of the type used in a spindle support for a rock bit used in oil drilling operations. Because stresses upon the workpiece 60 are concentrated most heavily upon one circumferential sector of a bearing raceway **60*a* of the finished workpiece 60 in its intended application, an insert 62 of an extremely hard metal alloy (for example, STELLITE) is embedded in this circumferential sector by metalizing. The workpiece 60 is depicted as being ground by the internal surface of the cup-shaped abrasive wheel 16. The grindability characteristics of the insert 62 are markedly different from the remaining portions of the raceway 60*a*. Consequently, for a given interface force between the grinding wheel 16 and the workpiece 60, different metal removal rates will be experienced for the different circumferential sections of the workpiece 60, seriously compromising the roundness which is critical for the bearing raceway 60*a***.

The disclosed apparatus approaches the above difficulty by varying the infeed, and consequently the interface force between the workpiece 60 and the abrasive wheel 16 within a single surface of revolution. This is accomplished in the preferred embodiment by matching the circumferential extension of the angle formed by the lobe **34*c* of cam 34 with the circumferential sector of workpiece 60 occupied by the hardened alloy insert 62. That is, the angle formed by straight lines extending from the ends of the insert 62 to the axis of rotation of the workpiece will match a corresponding angle formed by straight lines extending from the ends of the lobe 34*c* to the axis of rotation for the cam 34. Further, the cam 34 is fixed to the workpiece spindle 30 to establish a predetermined angular relationship between the two angles. This relationship is such that the period in which the abrasive wheel 16 is grinding engagement with the hardened insert 62 coincides with engagement of cam follower 50 with the lobe portion 34*c* of cam 34. The cam 34 is thus used to generate signals representative of the grindability characteristics of the surface of revolution upon workpiece 60**.

The angular displacement of cam follower 50 dictated by its engagement with the lobe portion **34*c* of cam 34 rotates pulse generator shaft 38*a*. The rotation of the shaft 38*a* in turn causes the pulse generator 38 to produce electrical pulses, the number of pulses being dependent upon the magnitude of the angular displacement of the shaft 38*a***.

In the preferred embodiment, relative movement between the abrasive wheel 16 and the workpiece 60 is effectuated electrical stepping motors, activated by electrical pulses, which move the wheelhead table 19 along ways 21 and 23. Pulses produced by the pulse generator 38 are added (or substracted) to these pulses generated by a conventional digital feed machine control to modify the infeed rate. Thus, during the period in which the lobe 34c engages the cam follower 50, which substantially corresponds to the period when the grinding wheel 16 is in grinding contact with the hardened insert 62, an additional feed movement signal is supplied to the stepping motor drive to supplement that produced by the conventional digital feed machine control.

The abrasive wheel 16 is urged against the workpiece 60 by a force transmitted through the cantilever support of quill 18. Because the quill 18 and abrasive wheel 16 inherently deflect whenever the infeed motion is resisted by the workpiece 60, the workpiece force between the abrasive wheel 16 and workpiece 60 is dependent upon the deflection of the abrasive wheel. This deflection is in turn dependent upon the resilient force offered by the wheel, quill, bearings, etc. The additional feed signal produced by the pulse generator 38 supplements this resilient force during the period of radial sector grind as determined by the cam portion 34c. In the case of interrupted or partially interrupted cuts, the supplemental infeed signal from the pulse generator 38 is negative. This negative supplemental signal may be generated by a recess in the cam 34 or by inverting the output of pulse generator 38 resulting from rotational contact with a positive radial extension such as lobe 34c.

The grinding machine of the preferred embodiment undergoes a conventional interrupt and dress grinding cycle. Once the workpiece is loaded, the wheelhead table 19 is moved inwardly in a direction parallel to the axis of workpiece rotation along ways 21. After the table 19 has reached a predetermined point, axial movement is terminated and the table 19 is moved transverse to the workpiece axis along ways 23. Once grinding is initiated transverse movement is made at a relatively fast rough feed rate which continues until the workpiece reaches a first predetermined rough size. This rough size generally reserves a small amount of material (0.001 to 0.002 inch would be typical) to be removed upon a subsequent portion of the grinding cycle and may be determined by a SIZEMATIC gage control (SIZEMATIC is a registered trademark of the Cincinnati Milacron-Heald Corp.).

After the rough size has been reached, the table is backed off along ways 23. The table 19 is then retracted along ways 21 to move the abrasive wheel 16 to a compensation and dress position. The wheel 64 is compensated and dressed at this position by a formed diamond wheel dresser after which the table 19 is moved inwardly once more to the predetermined point. A rapid transverse approach to the workpiece is then initiated by the stepping motors along ways 23 to move the table 19 to the first size position which will be slightly short of the workpiece contact with the newly dressed abrasive wheel 16. The stepping motor then advances the table at a relatively slower fine feed rate to a second predetermined size of the workpiece. In the conventional grinding cycle a finish spark out interval is then commenced in which no further infeed is initiated by the stepping motors. Instead the grinding force for this portion of the cycle is normally supplied solely by the residual resilient force developed by the abrasive wheel support system during the infeed movement of the fine feed rate.

Applicant has found that the pulse generator control of the abrasive wheel infeed may be successfully limited to this finish spark-out interval of the grinding cycle in the preferred embodiment. If this approach is adopted, during finish spark-out, not only is the interface force between the abrasive wheel 16 and the workpiece 60 supplied by the residual spring force of the deflected wheel support system; it is also supplemented during the particular angle displacements of the workpiece 60 by additional table movement initiated by pulses from pulse generator 38.

Since the pulse generator 38, in the preferred embodiment is not active throughout the entire grinding cycle, it is desirable to begin and terminate its active period when the cam follower is in an inactive position, i.e., not upon the lobe section 34c. The screwhead 44 is used, in conjunction with the proximity switch 42 to insure that the times for starting and stopping conform to this requirement. A signal from the workpiece size control (SIZEMATIC) indicating that the workpiece 60 has been machined to the finished size initiates the finish spark-out mode of the grinding cycle. The presence of the size control signal and a signal generated by the proximity switch 42 (from the proximity of screwhead 44) indicates that the cam 34 is in an inactive position during the finish spark-out mode, and that it is a suitable time to commence operation of the pulse generator control. The grinder operates in the finish spark-out mode for a predetermined period fixed by a timer. Since it is also undesirable to terminate the operation of the pulse generator 38 when it is generating signals, the apparatus is deactivated in a similar fashion. The presence of the signal from the timer indicating an end of the fixed time period and the signal from the proximity switch 42 indicates that the spark-out mode is over and the pulse generator 38 is inactive. This series of signals is thus used to activate the hydraulic cylinder 58 to rotate the lever 54, and consequently the cam follower 50 out of the path of the cam 34.

FIG. 7 is a logic diagram for a correction circuit for use with the apparatus of FIGS. 1–6 expressed in standard Boolean symbols. Stored information represented by the cam 34 contours is communicated to an incremental shaft encoder 66 by way of the cam follower 50 and lever 48. The encoder 66 generates square wave outputs in accordance to its angular displacement along two channels A and B. Whenever the follower 50 encounters an increase in the radial dimension of cam 34, the encoder 66 will be rotated in the clockwise direction; while a decrease in the radial cam dimension will impart counterclockwise rotation. Depending upon the direction of encoder 66 rotation, one of the channels A or B will be phase shifted 90° with respect to the other; and this phase shaft will be utilized to determine whether the grinder infeed will be positive or negative (retract).

The generated pulses along channels A and B are communicated to a direction phasing circuit 68. A third pulse input to the direction phasing circuit is selectively applied from an interface circuit whenever its associated switch 71 is closed. As will be apparent from the following description, the direction of grinder infeed movements resulting from an increase or decrease in the cam 3 radius will be reversed by opening the direction switch 71. Thus, a single variation in the cam 34 radius may be used to represent a positive or negative variation in the grindability characteristics of the workpiece 60.

The direction phasing circuit 68 is comprised of four AND gates 72, 74, 76, 78, two NOR gates 80,82 and an inverter 84. The inverter 84 accomplishes a logic negation and assumes a positive (1) state output only if its input from interface circuit 70 is negative (0). The AND gate 72 is responsive to channel A and the output of inverter 84 and assumes the (1) state if and only if both of the inputs assume the (1) state. The AND gate 74 is responsive to channel B and interface circuit 70. The output of both AND gates 72 and 74 are applied to NOR gate 80 which assumes the (1) state only if neither of its inputs (from AND gates 72 and 74) assume the (1) state.

The AND gate 76 has channel A and interface circuit 70 as outputs and has its output applied to NOR gate 82. The AND gate 78 is responsive to channel B and inverter 84 and also applies its output to NOR gate 82. The output of NOR gates 80 and 82 are both communicated to a pulse generator circuit 85, the NOR gate 80 being directly applied to an inverter 86 and the NOR gate 82 being directly applied an inverter 88. The output of inverter 86 is applied to a one shot unit 92 and an inverter 90, the inverter 90 output being in turn applied to a one shot unit 94. Thus, the one shot 92 will generate a fixed duration pulse output for each negative edge of the output of NOR gate 80 and the one shot 94 will generate a fixed duration pulse output for each positive edge of the waveform produced at the NOR gate 80 output.

The output of one shot 92 is applied to AND gates 96 and 98. The AND gate 96 also has an output from inverter 88 and AND gate 98 has an input from an inverter 104 which negates the logic from inverter 88. The output one shot 94 is applied as inputs to AND gates 100 and 102, the former gate 100 receiving a second input from inverter 104 while the latter gate 102 receives a second input from inverter 88.

The outputs of AND gates 96 and 100 are applied to an OR gate 106 which assumes a (1) state if either of its inputs assume the (1) state. Another OR gate 108 receives inputs from AND gates 98 and 102 and assumes a (1) state if either of its inputs is positive. It can thus be seen that whenever encoder 66 is rotated, positive pulses will be output from one of the gates 106 or 108, and the other OR gates (106 or 108) will be null. Further, it can be seen that reversing the direction of encoder 66 rotation will output pulses at the other gate. Still further, it can be seen that which of gates 106 or 108 assume the (1) state is dependent upon whether the output of interface circuit 70 assumes the (1) or (0) state, and that by reversing the state of interface circuit 70 output, the (1) state is changed from one of the OR gates 106 and 108 to the other. The number of pulses output from one of the gates 106 or 108 will be twice the number generated by encoder 66.

The outputs of OR gates 106 and 108 are applied to AND gates 110 and 114 respectively. Each of these latter mentioned AND gates (110 and 114) has a second input from a correction mode circuit 120 which is activated to assume the (1) state whenever it is desired to activate the correction circuit. When the circuit is activated and one of the OR gates 106 or 108 assume the one state, the corresponding AND gate (110 or 114) will apply its output to OR gate 122 or 126, the OR gates 122 signalling a positive infeed movement of a sequence driver 128 and the OR gate 126 signaling a negative or retract movement. Outputs from AND gates 110 and 114 are also applied to a NOR gate 112 which in turn applies its output to a flip flop 118. The flip flop 118 outputs to one of two AND gates 130 and 132, which have second inputs from the sequence driver 128 and an inverter 136 which negates the logic from the driver 128. NOR gate 134 receives the outputs of AND gates 130 and 132 as inputs and applies its output to an OR gate 124. The OR gates 122, 124 and 126 have second input from AND gates 137, 138 and 140 respectively. The latter AND gates (137, 138, 140) are responsive to inputs from the grinding machines digital feed system 142 and to an input from the correction mode circuit 120, the latter input being inverted by an inverter 144. Inputs to the sequence driver 128 are then used to drive a stepping motor 129 to control the grinder infeed.

While the preferred embodiment is capable of continually modifying the infeed to match the grindability characteristics of the workpiece, it should be apparent that applications requiring the infeed rate to vary only for discrete intervals (such as workpiece 60 described above) might use other means, as for example magnetic limit switches, to determine which portion of the workpiece is in grinding contact with the abrasive wheel. Additionally, the invention might be used upon a grinding machine without an axis of workpiece rotation, as for example a surface grinder, to match the relative infeed rate to the grindability of the workpiece.

The infeed movement or grinding wheel-workpiece interface force may also be controlled adaptively. This may be accomplished, for example, by sensing either the current or power drawn by the spindle drive motor for the grinding wheel. A change in the grindability characteristics of the workpiece, such as the STELLITE insert or the interrupted cut described above, would precipitate a corresponding change in the current (or power) drawn by the spindle drive motor. Inasmuch as this measured change in current (or power) would be proportional to the change in grindability, This value could be used to vary the number of supplemental pulses transmitted to the infeed stepping motor. The control could be adjusted by an adjustable gain control (as, e.g., a potentiometer) which would adjust the proportionality between the detected current or power signal and the number of supplemental pulses required to accommodate variable grinding wheel support resiliency. The proportionality could, of course, be adjusted higher for a system with low stiffness or low load meter sensitivity.

Alternatively, the strain between the wheelhead platform (slide) and the infeed motor drive might be detected (as, e.g., by a strain gauge) and used to control the number of supplemental pulses in lieu of the spindle motor load detection means.

Although the present invention has been claimed in conjunction with the preferred embodiments it is to be understood that modifications and variations may be resorted to without departing from the spirit of invention as those skilled in the art will readily understand. Such modifications and variations are considered to be within the view and scope of the present invention as defined by the appended claims.

What is claimed is:

1. A method of grinding the surface of a workpiece having disparate material removal rates for a constant interface force between the grinding wheel and workpiece, comprising:

(a) defining discreet workpiece surface areas which have different material removal rates in a grinding operation for a constant unit interface force between the grinding wheel and workpiece areas;

(b) storing information representative of the location of the discreet areas of the workpiece surface;

(c) infeeding the grinding wheel relative to the workpiece surface to establish grinding contact therebetween;

(d) adjusting the interface force between the grinding wheel and workpiece surface produced by the grinding infeed during grinding contact in response to a signal representative of the stored information as the grinding wheel contacts each of the discreet sectors so as to maintain a substantially constant grinding wheel infeed movement and compensate for deflection in the grinding wheel support system.

2. A method of grinding the surface of a workpiece with at least two zones of dissimilar materials to a prescribed geometry, which comprises:

(a) storing information representative of the location on the workpiece surface of at least two zones of dissimilar material;

(b) effectuating relative infeed between a grinding wheel and a workpiece to establish grinding contact therebetween;

(c) utilizing the stored information to modify the relative infeed between the grinding wheel and workpiece to compensate for deflection in the grinding wheel support system so as to maintain a substantially constant material removal rate.

3. A method of grinding a circular workpiece surface with discrete zones of dissimilar material to a prescribed geometry which comprises:

(a) storing information representative of the location of at least two of the zones of material on the workpiece surface;

(b) infeeding a grinding wheel relative to the workpiece to establish grinding contact therebetween;

(c) utilizing the stored information to adjust the interface force to a first predetermined level during grinding contact with one of the material zones on the workpiece and to a second predetermined level during grinding contact with at least one of the other zones.

4. A method as recited in claim 3 wherein the information is stored upon a mechanical cam.

5. A method as recited in claim 4 further comprising the steps of converting information recorded upon the mechanical cam into electrical pulses and utilizing the electrical pulses to vary the infeed motion between the workpiece and the abrasive wheel.

6. A method as recited in claim 5 wherein the mechanical cam is rotated with the workpiece.

7. A method as recited in claim 6 wherein the mechanical cam is rotated about an axis coincident with the axis of workpiece rotation.

* * * * *